US009416559B2

(12) United States Patent
Brechon

(10) Patent No.: US 9,416,559 B2
(45) Date of Patent: Aug. 16, 2016

(54) STEEL SUPPORTED POLYMERIC FENCE POST

(71) Applicant: Timothy W Brechon, Paris, MI (US)

(72) Inventor: Timothy W Brechon, Paris, MI (US)

( * ) Notice: Subject to any disclaimer, the term of this patent is extended or adjusted under 35 U.S.C. 154(b) by 351 days.

(21) Appl. No.: 14/093,677

(22) Filed: Dec. 2, 2013

(65) Prior Publication Data

US 2014/0151619 A1 Jun. 5, 2014

Related U.S. Application Data

(60) Provisional application No. 61/732,319, filed on Dec. 1, 2012, provisional application No. 61/836,722, filed on Jun. 19, 2013.

(51) Int. Cl.

| | |
|---|---|
| ***E04H 17/22*** | (2006.01) |
| ***E04H 17/14*** | (2006.01) |
| ***E04H 17/20*** | (2006.01) |

(52) U.S. Cl.

CPC ..... *E04H 17/1413* (2013.01); *E04H 17/20* (2013.01); *E04H 17/22* (2013.01); *E04H 2017/1456* (2013.01)

(58) Field of Classification Search

CPC ..... E04H 17/02; E04H 17/04; E04H 17/06; E04H 17/08; E04H 17/12; E04H 17/1413; E04H 17/1417; E04H 17/1421; E04H 17/1434; E04H 17/20; E04H 17/22; E04H 2017/1447; E04H 2017/146; E04H 2017/1486

See application file for complete search history.

(56) References Cited

U.S. PATENT DOCUMENTS

| | | | | |
|---|---|---|---|---|
| 602,740 | A * | 4/1898 | Frame | 256/55 |
| 1,332,734 | A * | 3/1920 | McCarthy | 256/52 |
| 4,465,263 | A * | 8/1984 | Robbins, Jr. | 256/52 |
| 4,860,996 | A * | 8/1989 | Robbins, III | 256/10 |
| 5,755,431 | A * | 5/1998 | Williams | 256/19 |
| 6,612,551 | B1 * | 9/2003 | Roy | 256/1 |
| 6,834,846 | B2 * | 12/2004 | Robbins, III | 256/10 |
| 2010/0308292 | A1 * | 12/2010 | Rawls | 256/47 |
| 2011/0062404 | A1 * | 3/2011 | Shepherd | 256/34 |

OTHER PUBLICATIONS http://www.horse.com/item/safe-fence-vinyl-sleeve-for-steel-t-post/BXJ20/ (last visited Jan. 24, 2014).

http://www.horseguardfence.com/shop/cat40.php (last visited Jan. 24, 2014).

http://www.centaurdirect.com/t-post-accessories.aspx (last visited Jan. 24, 2014).

* cited by examiner

*Primary Examiner* — Michael P Ferguson

(74) *Attorney, Agent, or Firm* — Oppenhuizen Law PLC; David L. Oppenhuizen

(57) ABSTRACT

A solid polymeric fence post having a cross-shaped axial opening therein that readily and easily receives a T-shaped or Y-shaped metal fence post. The fence post provides an aesthetic and pleasing appearance while simultaneously facilitating ease of installation and permitting the use of wood, polymeric, or metal rails, offering more aesthetic options. The fence post also provides greater flexibility in attaching electrical deterrents in a more secure and pleasing manner than with traditional metal fence posts.

7 Claims, 3 Drawing Sheets

STEEL SUPPORTED POLYMERIC FENCE POST

CROSS REFERENCE TO RELATED APPLICATIONS

This application is a non-provisional application of and claims the priority of U.S. Provisional Application No. 61/732,319 filed Dec. 1, 2012, and U.S. Provisional Application No. 61/836,722 filed Jun. 19, 2013, the entire disclosure of both of which is incorporated herein by this reference for all purposes.

FIELD OF THE INVENTION

This invention relates to fence posts, and more particularly to a decorative and functional synthetic resin post that is securely mounted on a steel fence post and to a fence constructed therefrom.

BACKGROUND OF THE INVENTION

In the past, fence posts were typically formed from wood, spaced at periodic intervals. These posts were installed by digging holes for each post and then inserting the post in the hole. This is time consuming and labor intensive. The rails used with the traditional wood fence posts include wood beams, boards, or wire. As an alternative to wood posts, metal fence posts are sometimes used, particularly for use with wire rails. Such metal fence posts are commonly formed with a T-shaped cross section (known as a "T-post"). These are typically available in standard and heavy duty configurations. Variations of the metal fence post include a Y-shaped cross section.

One disadvantage with metal fence posts is that they are unattractive. Another disadvantage is that insulators are required when electric fencing is desired. Finally, the posts are only useful for metal fencing, and there is no readily available method for attaching plank rails to metal fence posts without substantial modification or alteration.

SUMMARY OF THE INVENTION

This invention is intended to replace many of the current fence designs that require holes to be dug and then either wood or plastic fence posts be fitted in the holes. The invention utilizes common steel T-posts that are driven into the ground. Polymeric posts are then placed over the steel T-posts. The design is unique in that the polymeric post is designed with a cross-shaped (+) cavity or hole that extends into the post from the lower end and allows the post to be snugly inserted over either a standard or heavy duty steel T-post. The cavity/hole is designed so that it provides a friction fit, thus eliminating fasteners and preventing the post from being lifted by an animal rubbing against it. The ability to drive a steel T-post into the ground and then simply place the polymeric post over the steel T-post allows the fence to be built quickly, be strong, and be economical.

BRIEF DESCRIPTION OF THE DRAWING FIGURES

DETAILED DESCRIPTION OF THE INVENTION

Figure 1:
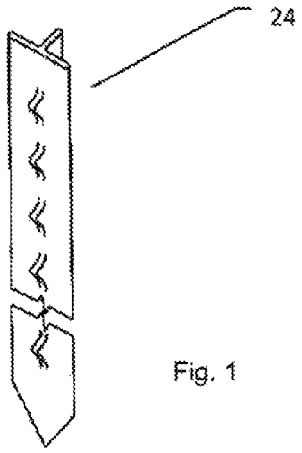
FIG. 1 is a perspective view of a traditional T-shaped metal fence post or T-post.
Figure 2:
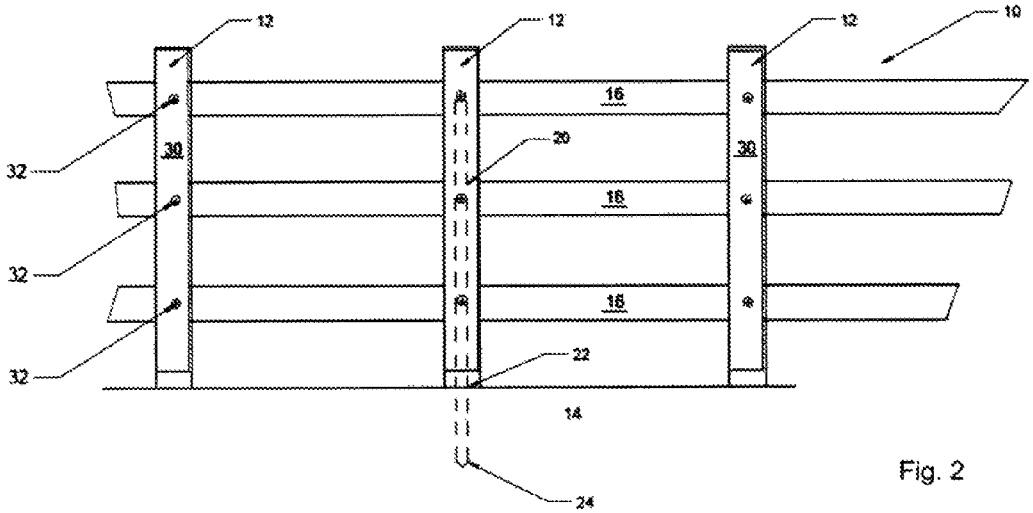
FIG. 2 is a front elevational view of a fence section employing the post of the present invention.
Figure 3:
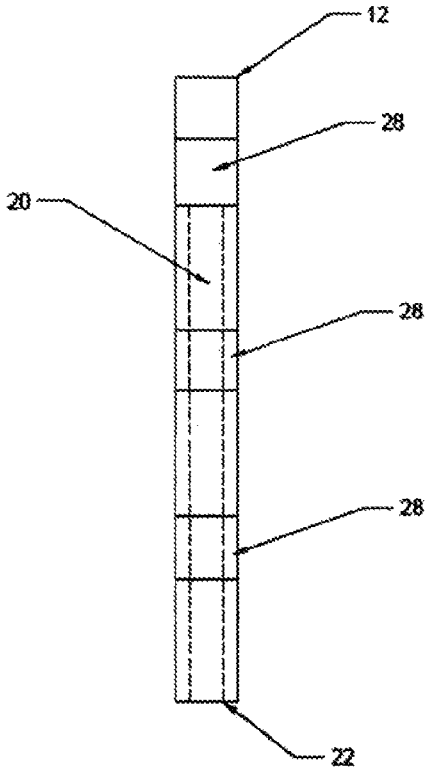
FIG. 3 is a front elevational view of one embodiment the fence post of the present invention.
Figure 4:
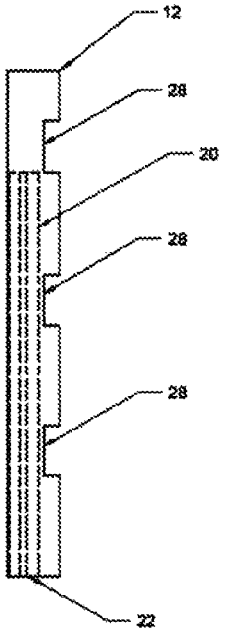
FIG. 4 is a side elevational view of the fence post shown in FIG. 3.

For purposes of the following description, the terms "upper," "lower," "left," "rear," "front," "vertical," "horizontal" and derivatives of such terms shall relate to the invention as oriented in FIG. 2. However, it is to be understood that the invention may assume various alternative orientations and configurations, except where expressly specified to the contrary. It is also to be understood that the devices and processes illustrated in the attached drawings and described in the following specification are simply exemplary embodiments of the inventive concepts of this invention. Specific dimensions and other physical characteristics relating to the embodiments disclosed herein are not to be considered as limiting unless expressly stated otherwise.

Figure 5:
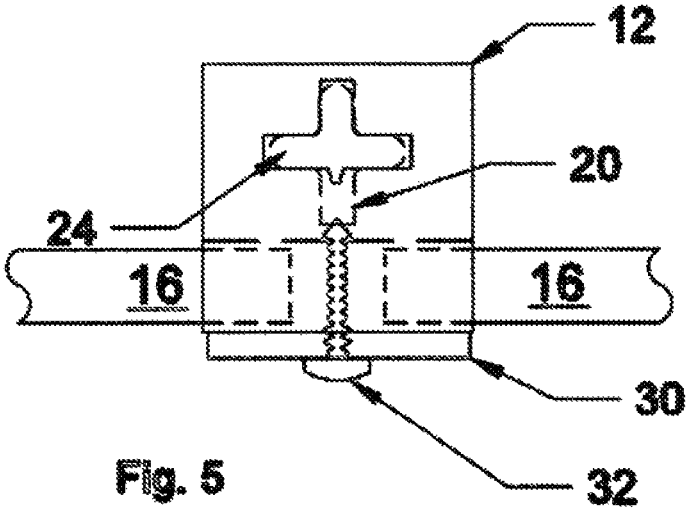
FIG. 5 is an overhead cross-sectional view of the fence post shown in FIG. 3.
Figure 6:
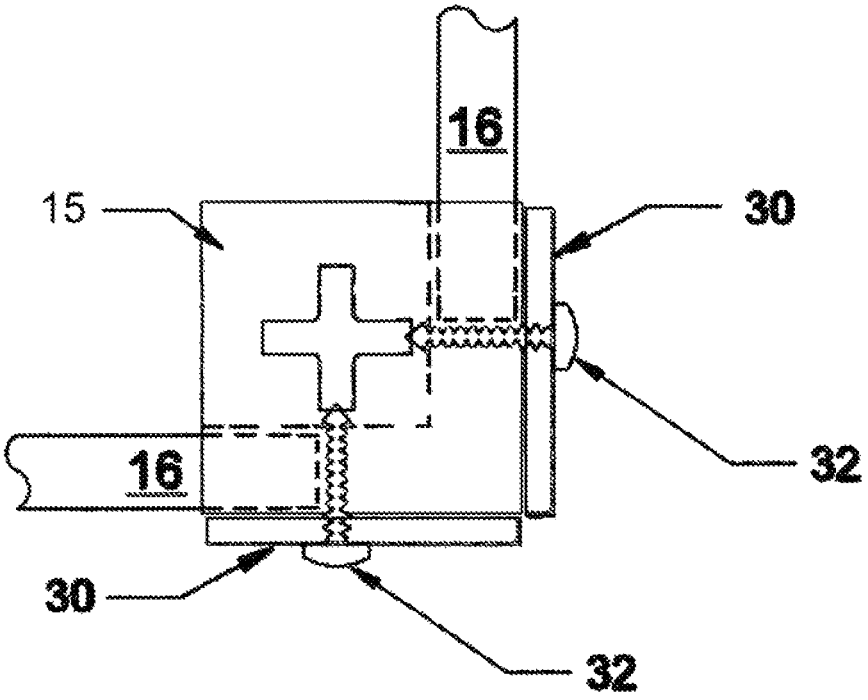
FIG. 6 is an overhead cross-sectional view of a corner post.

FIG. 2 is an elevational view of one embodiment of a fence 10 constructed in accordance with the present invention, showing a number of spaced fence posts 12 extending upwardly from the ground 14 and interconnected by a plurality of rails 16. In a preferred embodiment of the invention, each fence post 12 comprises an elongated polymeric body having any one of a number of geometric cross-sectional shapes (square, rectangular, round, etc.). In the embodiment shown, the fence posts 12 have rectangular cross-sections (as shown in FIG. 5). In one embodiment of the invention, each post 12 is formed from a polymeric material such as polyethylene, polyvinyl chloride, or other forms of polymer that are readily available. Moreover, it is preferred that the blend of polymer used be capable of having a UV stabilizer added thereto to make it resistant to UV radiation.

As shown in the drawings, each post 12 includes a cross-shaped cavity 20 extending substantially through the length thereof from at a lower end of the post 22. The dimensions of the cavity 20 are preferably configured so as to tightly receive the cross-sectional dimension of a typical T-shaped steel post 24 that is or was previously anchored or otherwise placed in the ground 14. A cross-shaped cavity 20 with flanges a quarter of an inch wide is generally satisfactory to create a snug fit on a typical T-post 24. To keep the fence post 12 firmly anchored to the steel post 24, fasteners or anchors (not shown) may be driven through the sides of the polymeric fence post 12 at predetermined locations to penetrate the fence post 12 and engage the steel post 24 disposed within the cavity 20.

Unique with the invention are the slots 28 formed along one side of the post 12. By having these slots 28, horizontal wood or solid plastic board rails 16 may be inserted into the slots 28 and then covered with a vertical stile or cover panel 30 attached to the fence post 12 by screws 32 positioned between the ends of the adjacent rails 16 to hold the railing in place. This allows the fencing material of the rails 16 to expand or contract with temperature changes. The polymeric fence post 12 may also be manufactured without slots 28. Post 12 may be used where the owner wanted to install some type of electric fencing material such as vinyl tape, electrical braided rope, or wire. The electric fencing material can be easily attached to posts 12 without the need for separate insulators.

As briefly mentioned above, posts 12 may have any geometric shape, including rectangular, square, round, and the like. They can be made in various lengths depending on the intended use. For example, a sixty inch post may have a forty-eight inch cavity that could be used over a steel T-post that is driven into the ground so that only a portion is left above ground. A six-foot post can have a sixty-inch cavity for a higher fence. Corner posts 15 generally should be longer so that such posts can be set in concrete to withstand the pulling force exerted on the fence. Corner posts 15 may also have the horizontal slots 28 formed on adjacent sides for the fencing material. Corner posts 15, or end posts can be used for end of fence runs or where a gate or opening is needed. These corner posts 15 are also generally longer so as to allow them to be set in concrete and have the slots on one side.

It is contemplated that fence posts be made from a plastic material such as recycled plastic milk jugs or some other plastic. Dyes can be added during manufacture to produce white, black, brown, gray, or some other color that is desired to be throughout the post. The posts can also have wood grain texture molded in to simulate real wood. Because the posts are generally manufactured from a polymer, the posts are resistive to rotting, insects, and sunlight deterioration.

The fence 10 of the present invention is very easy to build. First, the corner or end posts 15 are installed in concrete. Then the steel posts 24 are placed in the ground 14 at proper spacing depending on whether wood rails 16 are to be used. If wood rails 16 are to be used, the spacing should be such that the ends of each rail 16 are centered on the steel posts 24. Then plastic posts 12 are slid or tapped down over the steel posts 24. Wood rails 16 are installed into the slots 28 on each fence post 12 and secured by installing a short vertical board 30 over the slots 28.

As shown in FIG. 5, using screws 32, the vertical board 30 is attached to the fence post 12. The screws 32 are installed into the vertical board 30 such that each screw 32 is centered in each slot 28 and does not pass through any wood rail 16. This allows for each rail 16 to expand and contract but does not allow it to move so much that it will slip out of the slot 28 in which the rail 16 is installed. If a solid post (without slots) is used, the fencing material, braided wire rope, vinyl strapping, or electrical wire is simply attached to each post using screws, staples, or nails. The fence is easy to build, and, when completed, the fence is durable and visually appealing.

The only disadvantage of the design of the present invention is that, in most instances, the posts are somewhat heavy. This, however, can really be an advantage, since once installed the posts form sturdy fences that provide significant resistance to being lifted by an animal. There are many other advantages to this type of fence post as well. The ease of installation, yet strength of build that is created by utilizing easily installed steel posts is an important feature. The ease of using many different types of fencing material, including electrical fencing without the need for insulators, is another significant feature. Finally, these posts are capable of being very competitively priced by being made from recycled plastic as compared to other fencing options. This use of recycled materials is also good for the environment, as it reduces landfill waste.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention.

I claim:

1. A fence comprising a plurality of laterally spaced fence posts and lateral rails extending therebetween, the fence comprising:

a first fence post comprising:

a metal interior support member having at least two elongated, non-parallel flanges thereon that extend along a longitudinal length of the interior support member, the interior support member having a lower end that can be pounded into a ground surface such that an upper portion of the interior support member is held in an upright position above the ground surface; and an elongated exterior post member formed of solid synthetic resin material, the exterior post member having a slotted opening in the interior thereof extending upwardly from a lower end of the exterior post member, the slotted opening corresponding to the cross-sectional shape of the interior support member and fitting snugly over the flanges of the interior support member so as to restrain linear and rotational movement therebetween, the exterior post member having an enlarged cross section relative to the interior support member, the exterior post member being formed so as to extend downwardly over the interior support member to an end position wherein the lower end of the exterior post member is adjacent to the ground surface when the exterior post member is installed on the interior support member, the exterior post member also having a first plurality of vertically spaced lateral fencing grooves in an outer side thereof;

a first lateral fencing rail and a second lateral fencing rail, the fencing rails being comprised of wood or synthetic materials, the first and second fencing rails having ends thereof which are positioned within one of the plurality of fencing grooves such that the first and second fencing rails are vertically supported thereby but also longitudinally movable therein; and a groove cover positioned on the outer side of the exterior post member, the groove cover being shaped to fit over the ends of the first and second fencing rails and being fastened to the exterior post member so as to hold the ends of the first and second fencing rails in the groove while permitting the free longitudinal movement of the first and second fencing rails;

wherein the groove cover has the same exterior shape as and extends substantially the entire length and width of the outer side of the exterior post member, such that the placement of the groove cover on the exterior post member covers the first plurality of grooves and causes the grooves to have an appearance of transverse holes through the fence post when viewed from a side;

wherein the ends of the first and second fencing rails are spaced apart such that a vertical gap is created in the groove therebetween; and wherein the groove cover is fastened to the exterior post member by fasteners that pass through the vertical gap and do not extend through the first and second fencing rails, such that the first and second fencing rails can freely move laterally in the groove to accommodate length changes due to temperature changes.

2. The fence of claim 1 wherein:

the first fence post is vertically spaced from a second fence post, the second fence post having a second plurality of vertically spaced lateral fencing grooves in an outer side thereof, one of the second plurality of grooves being shaped to receive and support therein a second end of the first lateral fencing rail, and the distance between the first and second fence posts being such that the first rail is permitted some relative longitudinal movement from heat and cold expansion or being shifted by an animal rubbing against it without the ends of the first rail being removed from the grooves.

3. The fence of claim 1 wherein:

the fence encloses a non-circular fenced area having corners, and the fence having corner fence posts at the corners.

4. The fence of claim 1 wherein:

the interior support member comprises a T-post with three flanges, and the slotted opening in the exterior post member comprises longitudinal slots that fit over and engage the three flanges so as to resiliently resist longitudinal and rotational movement of the exterior post member over the interior support member.

5. The fence of claim 4 wherein:

the length of the slotted opening in the exterior post member is less than the length of the interior support member, such that when the interior support member is fully inserted in the slotted opening in the exterior post member, a lower portion of the interior support member protrudes out of the lower end of the exterior post member, the length of the lower portion being sufficient to hold the fence post in an upright position when the lower portion is fully inserted in the ground surface.

6. The fence of claim 1 wherein:

the interior support member comprises a T-post and the slotted opening in the exterior post member has a plus-shaped cross section, with four slots spaced 90° apart, the slots being narrow enough that the slotted opening in the exterior post member fits sufficiently snugly on the interior support member to resist axial separation of the exterior post member from the interior support member.

7. The fence of claim 6 wherein:

the slots in the slotted opening in the exterior post member are about a quarter of an inch wide.

* * * * *